US007252531B2

(12) United States Patent
Wu

(10) Patent No.: US 7,252,531 B2
(45) Date of Patent: Aug. 7, 2007

(54) CABLE CONNECTOR ASSEMBLY HAVING LOCKING MEMBER WITH BENT WINGS RETAINING THEREON

(75) Inventor: Jerry Wu, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/323,731

(22) Filed: Dec. 30, 2005

(65) Prior Publication Data

US 2006/0110972 A1 May 25, 2006

Related U.S. Application Data

(63) Continuation-in-part of application No. 10/787,661, filed on Feb. 25, 2004, now Pat. No. 6,991,487.

(51) Int. Cl.
*H01R 13/627* (2006.01)

(52) U.S. Cl. ..... 439/358

(58) Field of Classification Search ..... 439/351, 439/352, 353, 354, 355, 356, 357, 358, 555, 439/557, 575

See application file for complete search history.

(56) References Cited

U.S. PATENT DOCUMENTS 5,213,533 A 5/1993 Walden
5,727,963 A 3/1998 Lemaster
5,775,931 A 7/1998 Jones
5,860,826 A 1/1999 Chang
5,941,725 A * 8/1999 Brennan et al. ..... 439/357
5,941,726 A 8/1999 Koegel et al.
6,059,612 A * 5/2000 Aoyama et al. ..... 439/701
6,099,339 A 8/2000 Yanagida et al.
6,210,202 B1 4/2001 Kuo
6,290,530 B1 * 9/2001 Chang ..... 439/378
6,558,183 B1 5/2003 Ji et al.
6,565,383 B1 5/2003 Wu
6,585,536 B1 * 7/2003 Wu ..... 439/358
6,585,537 B1 7/2003 Lee
6,648,666 B1 * 11/2003 Wu ..... 439/352
6,786,755 B2 9/2004 Dambach et al.
6,817,887 B2 * 11/2004 Jones et al. ..... 439/405

* cited by examiner

*Primary Examiner*—Chandrika Prasad
(74) *Attorney, Agent, or Firm*—Wei Te Chung

(57) ABSTRACT

A cable connector assembly (1) for mating with a complementary connector, comprises an insulative housing (10), a plurality contacts (20) disposed in the housing, a plurality of cables (40), a pair of upper and lower covers (51, 52) and a pair of locking member (60). The insulative housing defines a first retention cavity (111) extending in a front-to-back direction. The upper and lower covers, respectively, defines a pair of U-shaped second retention cavities (513) therein, respectively, the first retention cavities aligned with the corresponding second retention cavities in a front-to-back direction. The locking member received in the first and second receiving cavities, and comprises at least a pair of wings (611). The wings respectively corporate with the upper and the lower covers and exert forces to the upper and the lower covers along an up-to-down direction to hold the upper and the lower covers together.

15 Claims, 11 Drawing Sheets

CABLE CONNECTOR ASSEMBLY HAVING LOCKING MEMBER WITH BENT WINGS RETAINING THEREON

CROSS-REFERENCE

This is continuing-in-part of U.S. patent application Ser. No. 10/787,661, filed on Feb. 25, 2004 now U.S. Pat. No. 6,991,487 and entitled "CABLE CONNECTOR ASSEMBLY HAVING LOCKING MEMBER" which have the same applicant and assignee as the present invention.

BACKGROUND OF THE INVENTION

1. Field of the Invention

The present invention relates to a high profile cable connector assembly, and particularly to a cable end connector assembly having a locking member for locking with a complementary connector.

2. Description of Prior Arts

There exists in the art a cable end connector assembly known as a Serial Advanced Technology Attachment (Serial ATA) connector which is generally used for disk drives and storage peripherals. Especially, the Serial ATA connectors according to the Serial ATA standard are featured in fewer electrical contacts than other conventional electrical connectors and are relatively tiny in configuration. It is desirable for the Serial ATA connector to have latch means for providing a reliable mechanical and electrical connection with a complementary connector.

With the development of the Serial ATA standard, the next-generation serial storage interface effort expands the base Serial ATA 1.0 capabilities to address additional markets segments, including the server and networked storage markets. A cable end connector assembly based on Serial ATA II standard is designed to connect with more devices and cables. As the connector is probably applied to a wider profile, the locking means of the Serial ATA connector disclosed in the above-mentioned is not suitable.

For resolving above problem, an electrical connector with a pair of locking members assembled there with is disclosed, each comprises a middle portion retained on a connector housing, a pushing portion extending rearwardly from the middle portion, and a locking tab extending forwardly from the middle portion. The electrical connector further comprises a housing, a cover and a plurality of terminals. The cover is over-molded with the housing. Furthermore, the cover is also can be assembled on the housing for separating from the electrical connector easily.

So, a cable connector assembly having an improved locking member is desired.

SUMMARY OF THE INVENTION

An object of the present invention is to provide a cable connector assembly having an improved locking member for locking the cable end connector assembly with a complementary connector reliably.

To achieve the above object a cable connector assembly for mating with a complementary connector, comprises an insulative housing, a plurality contacts disposed in the housing, a plurality of cables, a pair of upper and lower covers and a pair of locking member. The insulative housing defines a mating port with a pair of opposite side portions by two sides thereof, each of said side portions defines a first retention cavity extending in a front-to-back direction. The upper and lower covers are assembled to a rear portion of the housing and assembled with each other in an up-to-down direction perpendicular to said front-to-back direction, and encloses front portions of the cables together, and defines a pair of opposite side portions with a pair of U-shaped second retention cavities therein, respectively, the first retention cavities aligned with the corresponding second retention cavities in a front-to-back direction. The locking members are assembled to the housing and the upper and lower covers, each locking member comprises a housing retention section engagingly received in the first receiving cavity of the housing, a cover retention section engagingly received in the second receiving cavities of the upper and the lower covers a spring section movable received in the second retention cavities and at least a pair of wings being formed with the cover retaining section. The wings respectively corporate with the upper and the lower covers and exert forces to the upper and the lower covers along said up-to-down direction to hold the upper and the lower covers together.

Other objects, advantages and novel features of the invention will become more apparent from the following detailed description of the present embodiment when taken in conjunction with the accompanying drawings.

DETAILED DESCRIPTION OF THE PREFERRED EMBODIMENT

Figure 1:
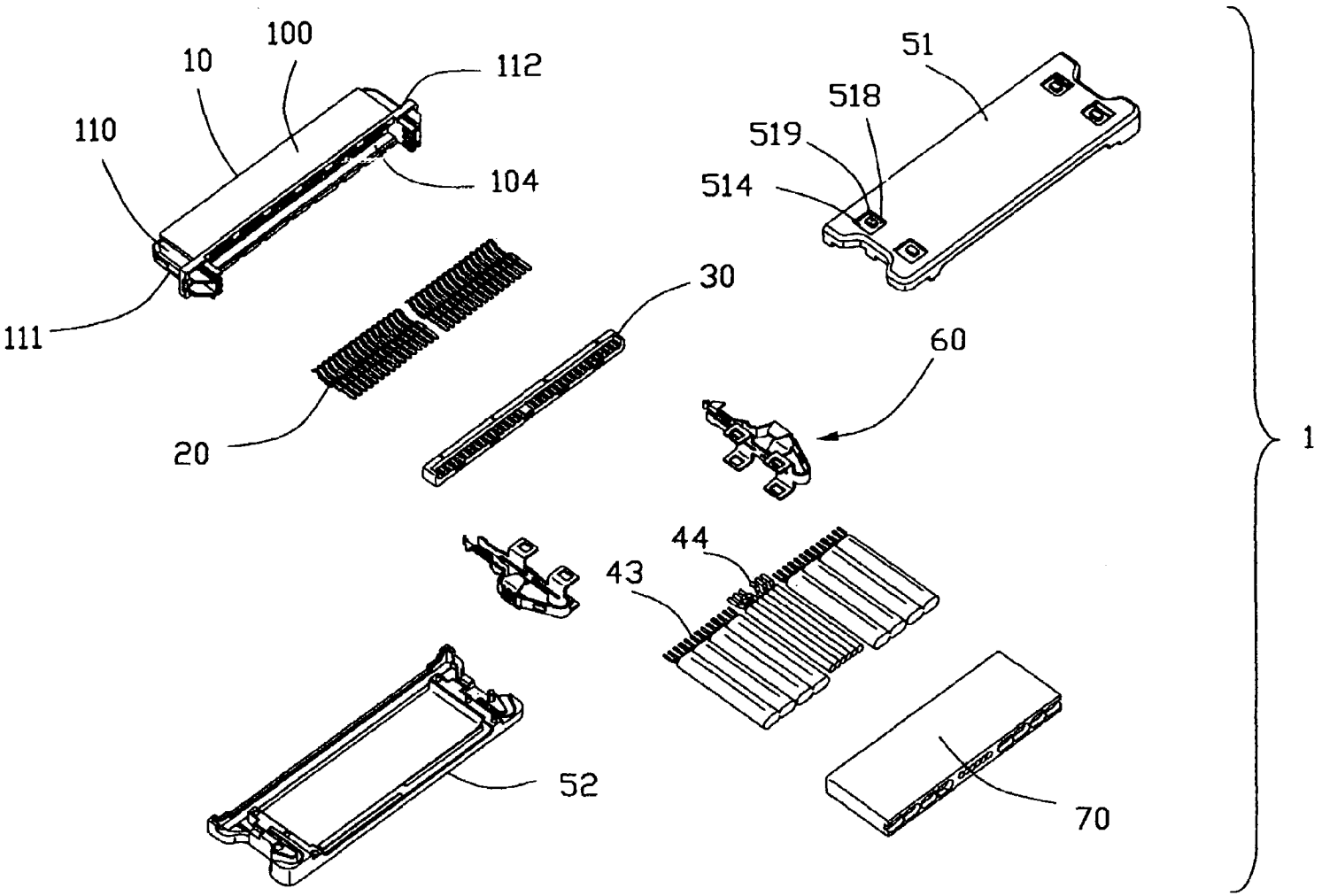
FIG. 1 is an exploded, perspective view of a cable end connector assembly in accordance with the present invention.

Referring to FIGS. 1 to 4, a cable end connector assembly 1 in accordance with the present invention comprises an insulative housing 10, a plurality of contacts 20, a spacer 30, a plurality of cables 40, a cover 50 and a pair of locking members 60. In the preferred embodiment, the cable end connector assembly 1 is in accordance with a Serial ATA II standard. However, in alternative embodiments, the electrical connector could be provided as other types.

Figure 2:
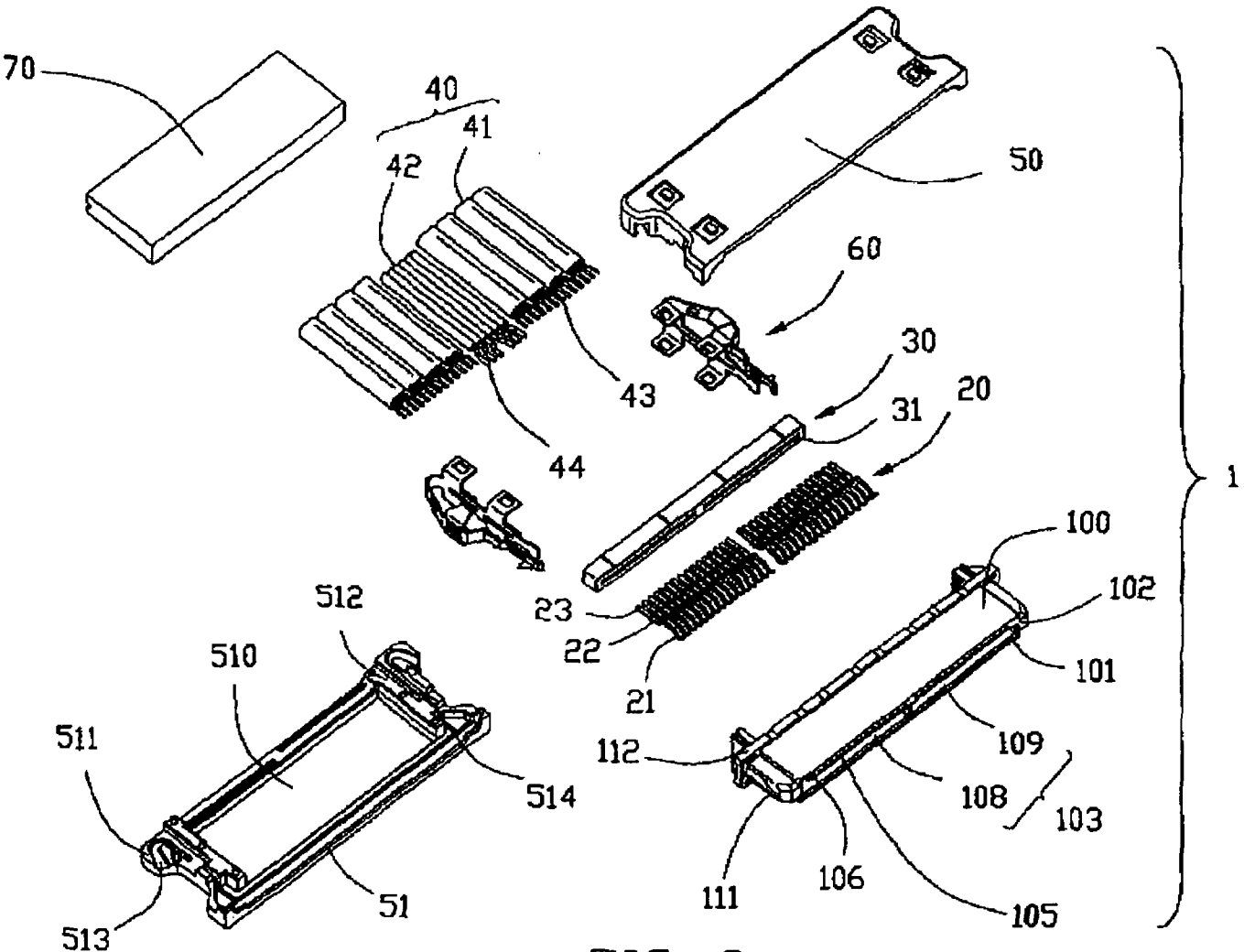
FIG. 2 is an exploded, perspective view of similar to FIG. 1, but taken from a different aspect.
Figure 3:
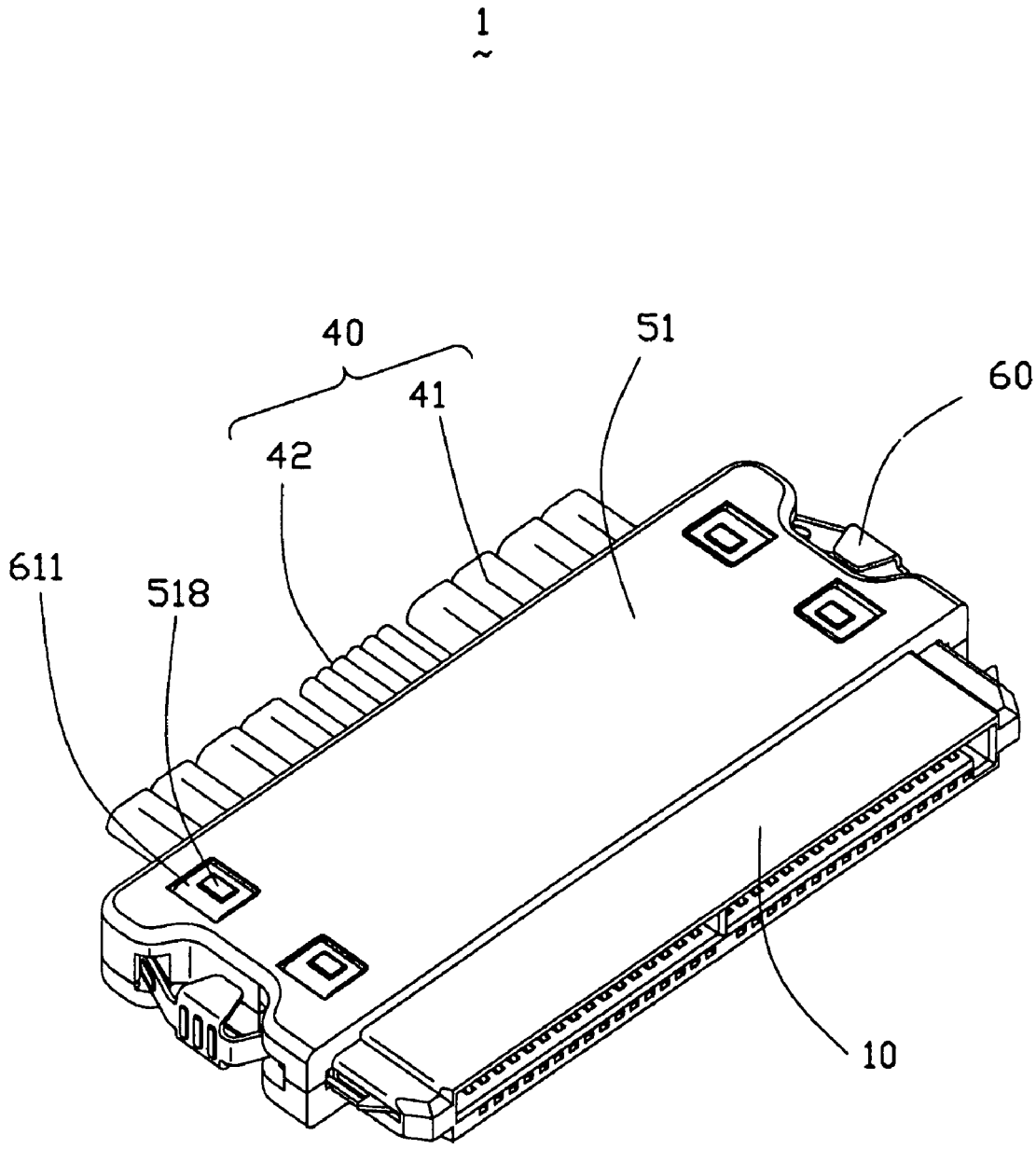
FIG. 3 is an assembled, perspective view of the cable connector assembly of FIG. 1.
Figure 4:
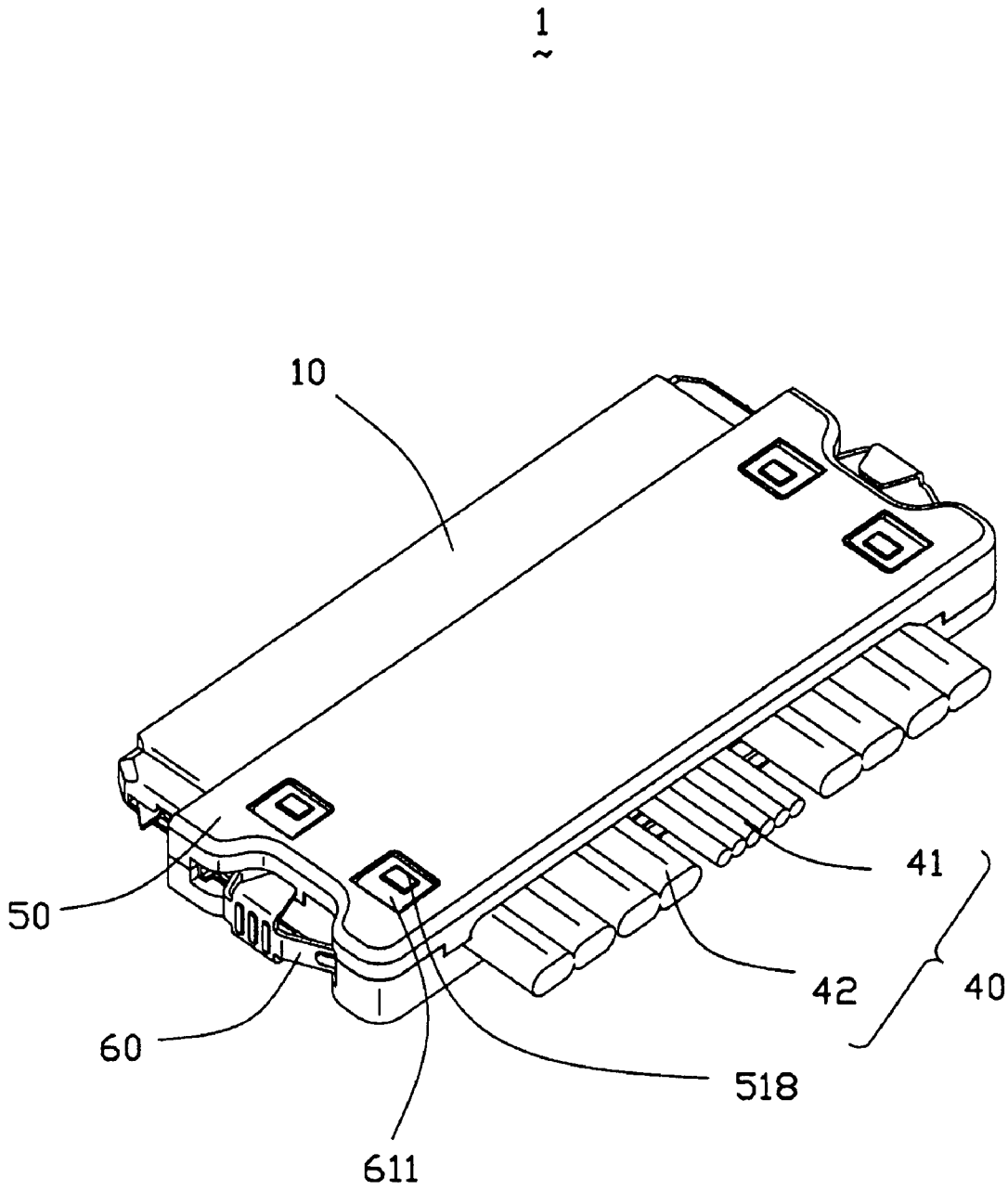
FIG. 4 is a view similar to FIG. 3, but taken from a different aspect.
Figure 5:
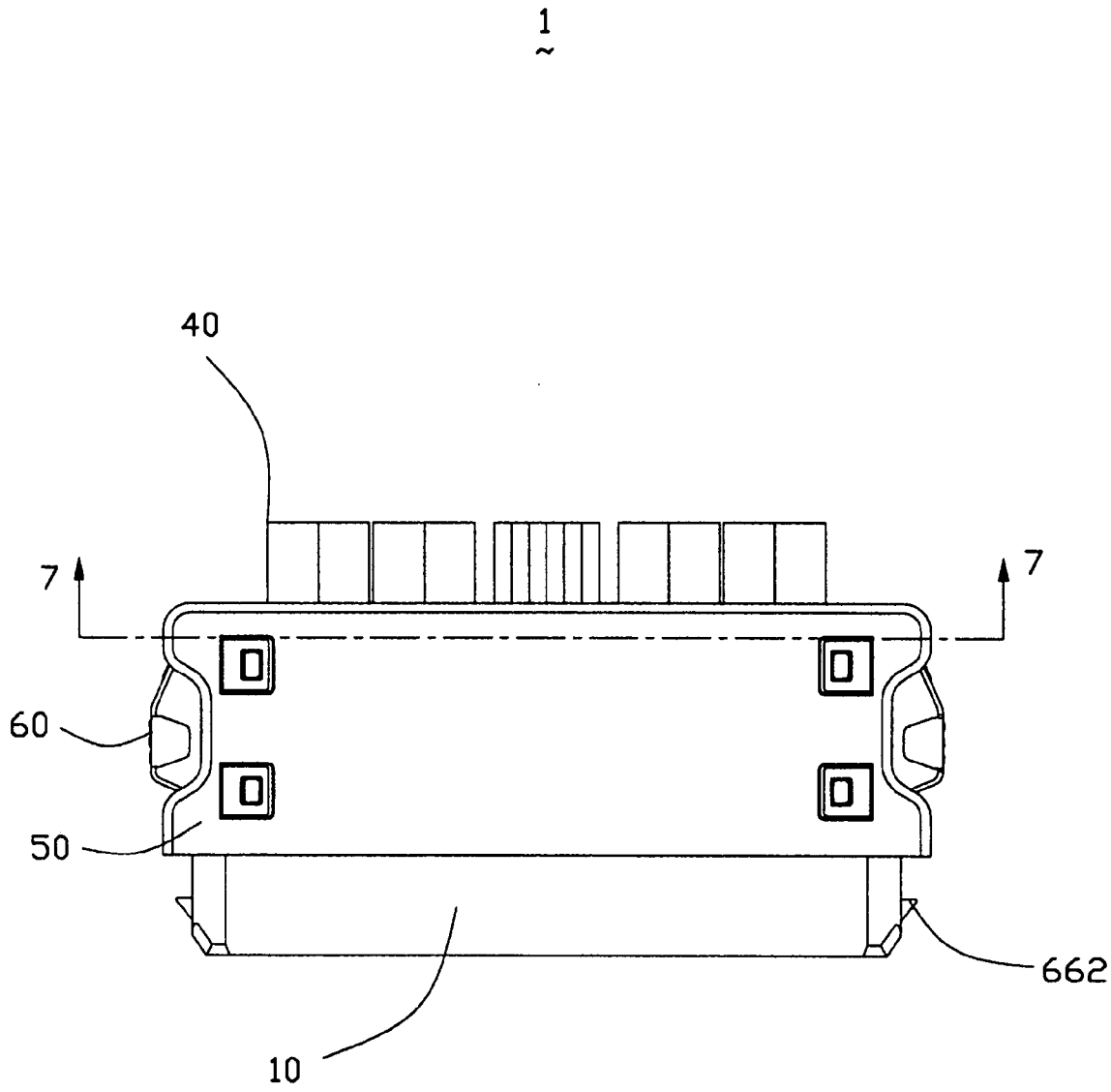
FIG. 5 is a top elevation view of the cable end connector assembly.
Figure 6:
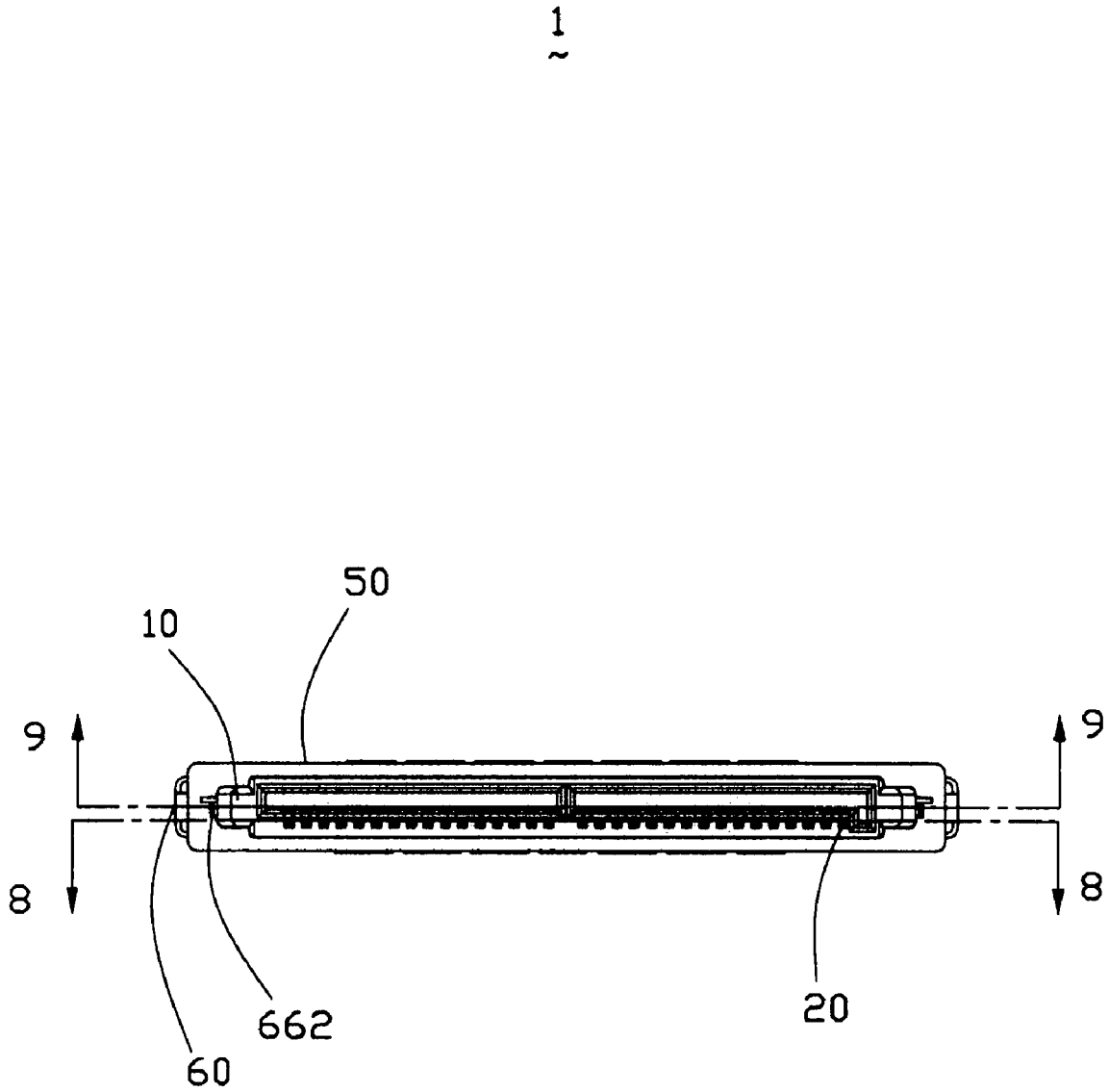
FIG. 6 is a front elevation view of the cable end connector assembly.
Figure 7:
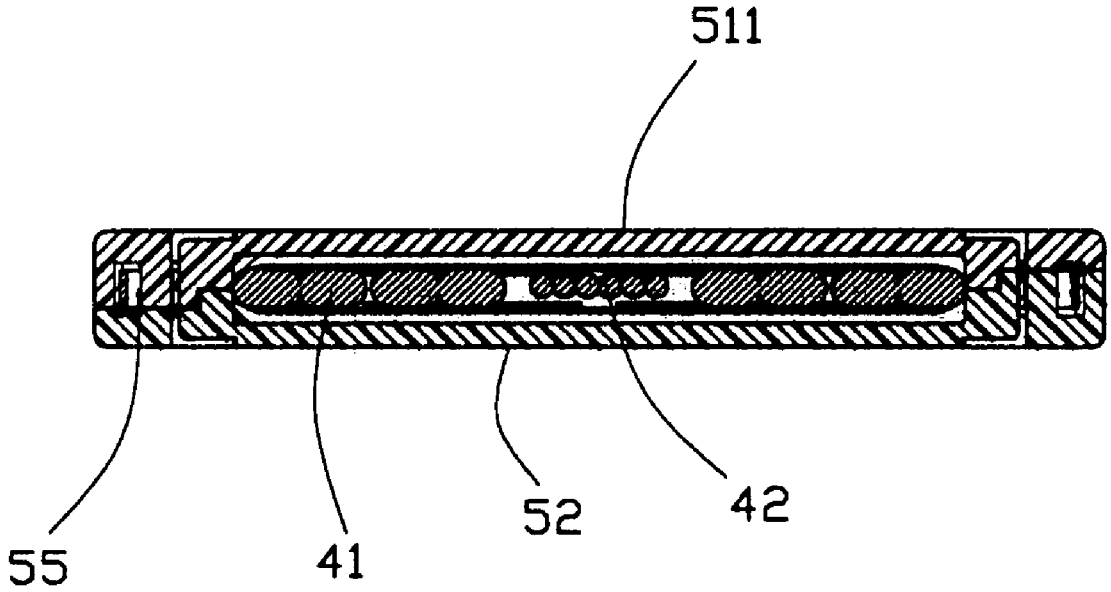
FIG. 7 is a cross-sectional view taken along line 7-7 of FIG. 5.
Figure 8:
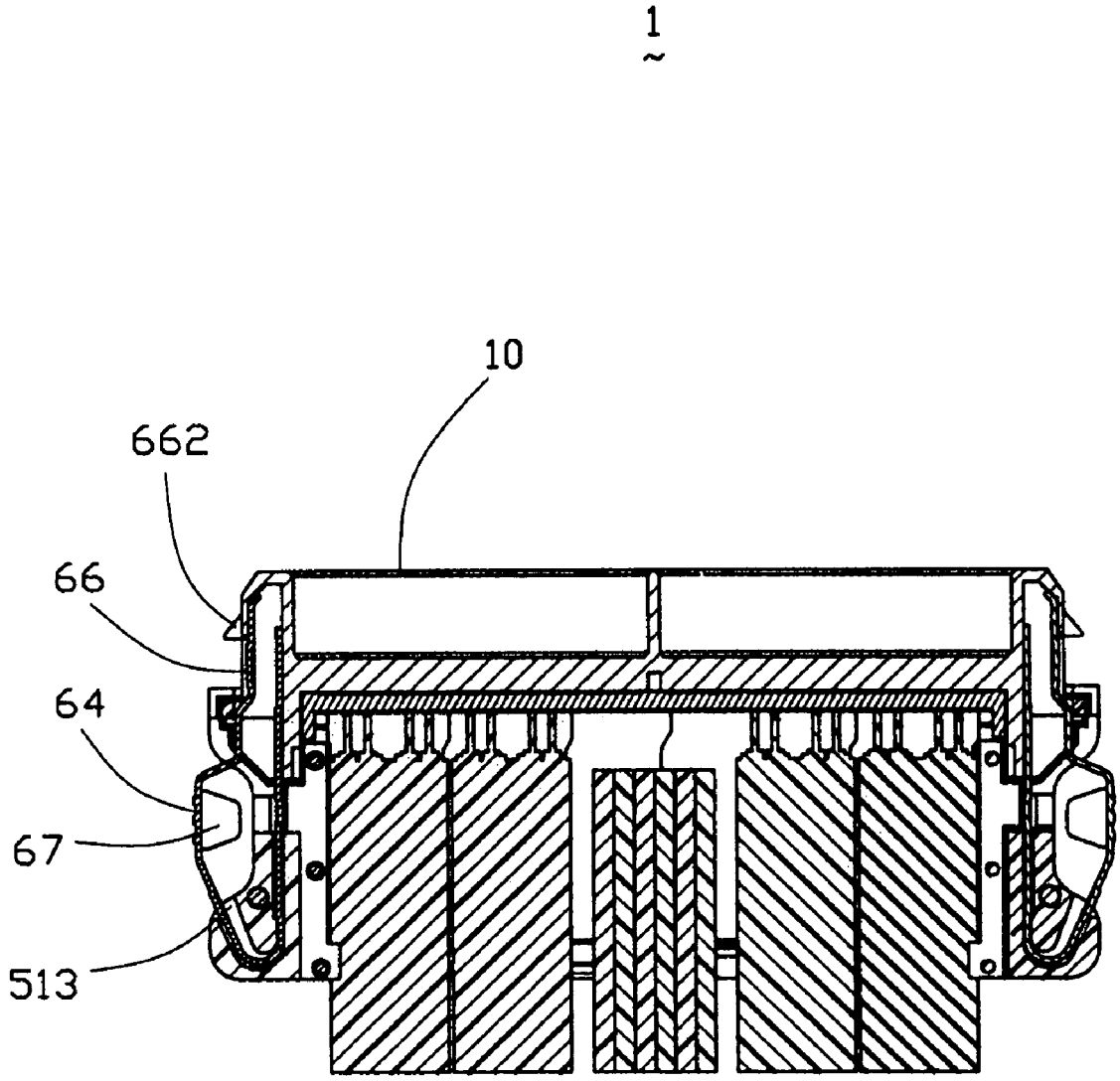
FIG. 8 is a cross-sectional view taken along line 8-8 of FIG. 4.
Figure 9:
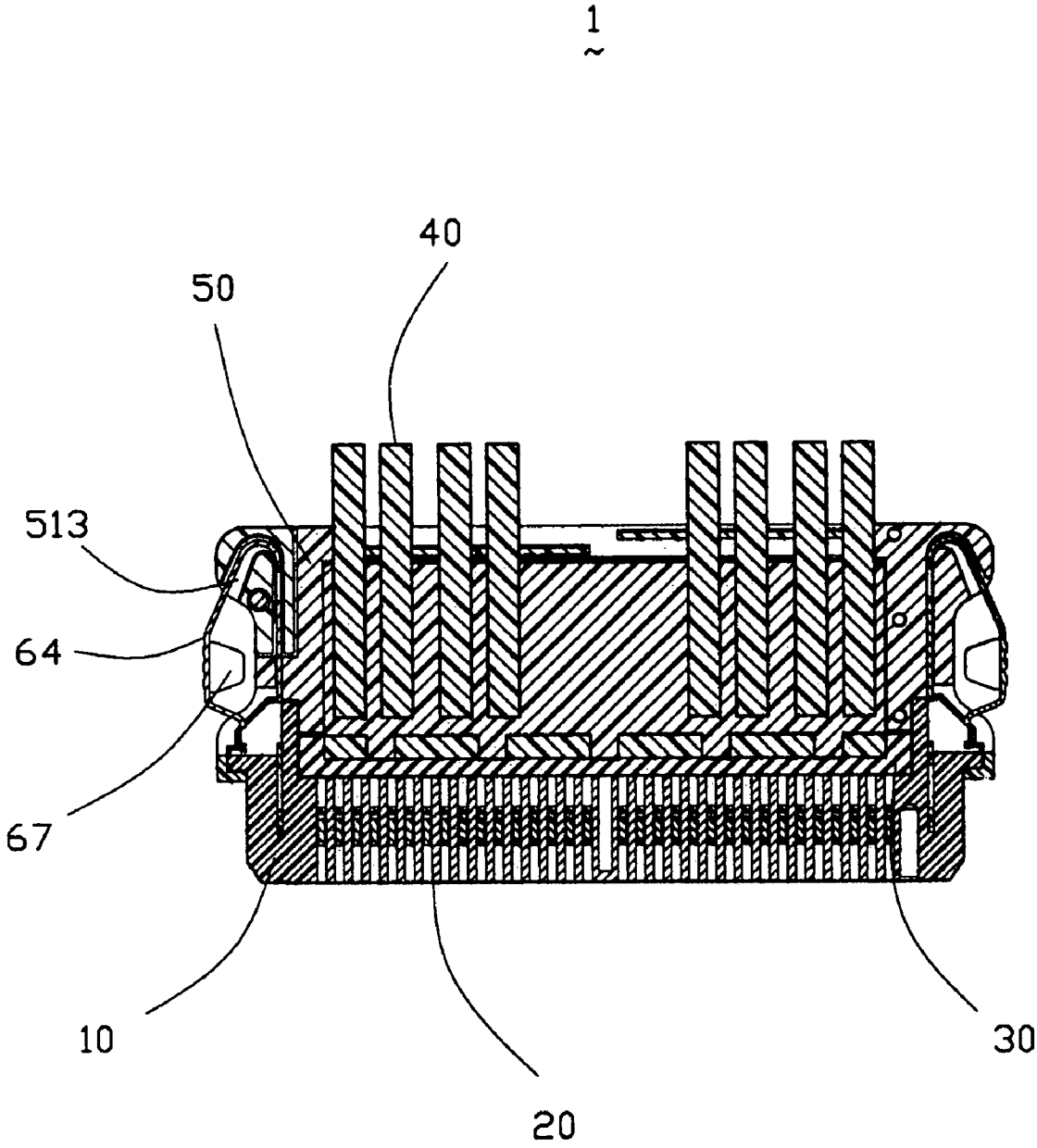
FIG. 9 is a cross-sectional view taken along line 9-9 of FIG. 6.

Particularly referring to FIGS. 1 and 2, the insulative housing 10 comprises an upper wall 100, a lower wall 101 opposite to the upper wall 100, and a pair of side portions 102 connecting with the upper wall 100 and the lower wall 101. Between the upper and the lower walls 100, 101, the housing 10 defines a front plug receiving space 103 and a rear spacer receiving space 104 for respectively receiving a complementary connector (not shown) and the spacer 30. A block 105 is formed on the upper wall 100 and protrudes toward the plug receiving space 103. The block 105 defines a plurality of passageways 106 extending therethrough and communicating with the plug receiving space 103 and the spacer receiving space 104. The plug receiving space 103 is divided into an L-shaped first port 108 and a rectangular second port 109 by a vertically extended partition wall (not labeled) for receiving complementary connectors with different profiles. Each side portion 102 defines a first retention cavity 111 recess inwardly from outer side surface thereof for engaging with the locking member 60. A baffle 112 is provided on a rear face of the housing 10.

Referring to FIGS. 1 and 2, the contacts 20 are received in the passageways 106 of the insulative housing 10 and each contact comprises a contact portion 21, a tail portion 23 and a housing retaining portion 22 connecting the contact portion 21 and the tail portion 23. The contact portions 21 extend into the L-shaped first port 108 and the rectangular second port 109 of the plug receiving space 103 of the housing 10, respectively. The housing retaining portions 23 are secured within the passageways 106 of the housing 10 by an interference fit. The spacer 30 is mounted to seal a rear end of the insulative housing 10, and comprises a plurality of through holes 31 recessed rearward from affront surface thereof for allowing the tail portions 21 of the contacts 20 extending therethrough. The spacer 30 can prevent plastic material from entering into the passageways 106 of the insulative housing 10 when molding an insulator 70. The contacts 20 and the spacer 30 can be integrally formed before mounting to the insulative housing 10, if desired.

The cables 40 comprise two pairs of first 4-lane cables 41 and a second flat ribbon cables 42 located between the first cables 41. The second cables 42 are divided into two groups. The first cables 41 and the second cables 42 are respectively designed to transit high-speed signal and low-speed sideband signal. Each cable 40 comprises a plurality of conductors 43, 44 exposed outside and extending towards the spacer 30 for being soldered to corresponding tail portions 22 of the contacts 20.

The insulator 70 is over-molded to enclose the cables 40 and enclosed by the covers 50.

Referring to FIGS. 1, 2, and 7-9, the cover 50 comprises an upper cover 51 and a lower cover 52 in mirror image with the upper cover 51. The upper cover 51 comprises a body portion 510 and two side portions 511 formed at the opposite sides of the body portion 510. Each side portion 511 is separated from the body portion 510 by a beam 512, and comprises a U-shaped second receiving cavity 513. A pair of passages 514 extending through the upper cover 51 are disposed at the second receiving cavity 513 in a front-to-back direction and adjacent to the beam 512. The upper cover 51 defines a plurality of depression portions 518 on the outer face corresponding to the passage 514, and each depression portion 518 defines a projection 519 therein. After the upper and the lower covers 51, 52 are assembled on the rear of the housing 10, the U-shaped second receiving cavity 513 on the upper cover 51 and the lower cover 52 together define a second retention cavity 55 (FIG. 7) communicating with the first retention cavity 111 of the insulative housing 10 along the front-to-back direction.

Figure 10:
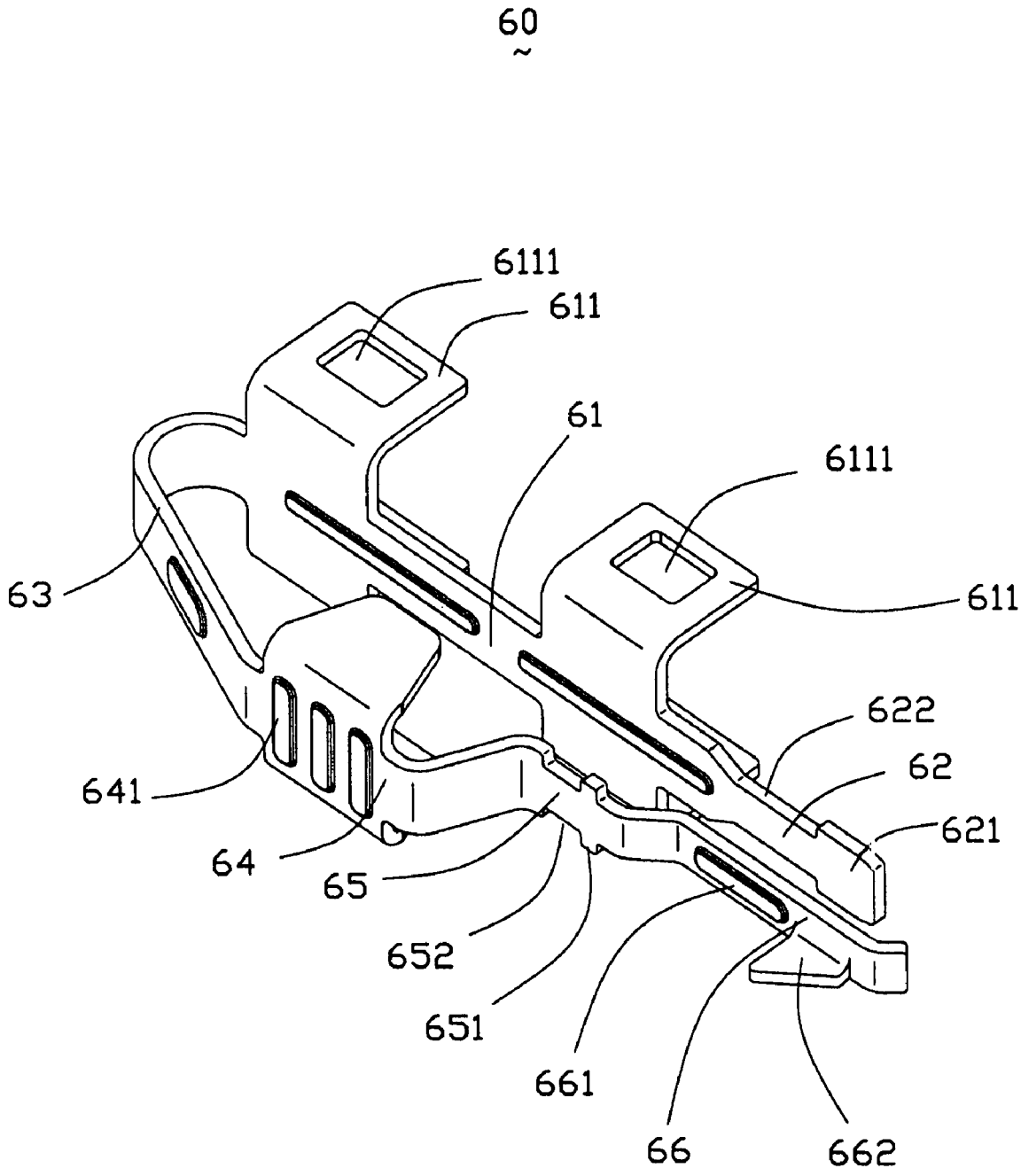
FIG. 10 is an enlarged view of a locking member shown in FIG. 1.
Figure 11:
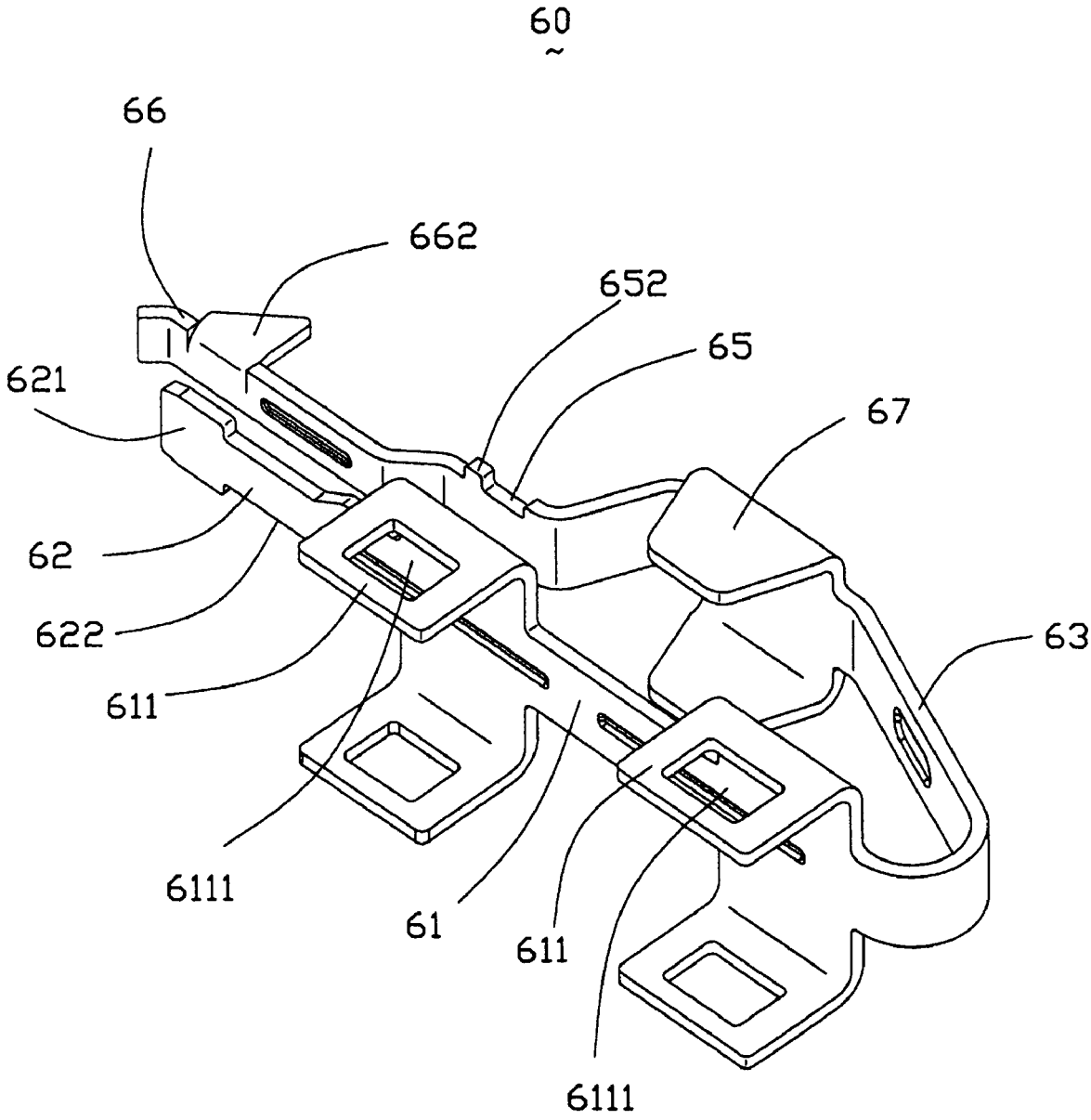
FIG. 11 is a view similar to FIG. 5, but taken from a different aspect.

Referring to FIGS. 10 and 11, each locking member 60 is stamped and formed from a metallic plate and comprises an elongate, housing retention section 62 extending along the front-to-back direction, a cover retention section 61 extending rearwardly from the housing retention section 62, a spring section 63 extending slantways from the cover retention section 61, a flat pushing section 64 extending forwardly from the spring section 63, an L-shaped positioning section 65 extending forwardly from the pushing section 64, and a latch section 66 extending forwardly from the positioning section 65. The housing retention section 62 is partially cut to form a pair of recesses 622, thus also form a retention tab 621 at a tip end thereof. The cover retention section 61 defines two pair of wings 611 which are firstly straight before assembled to the covers 50 and then bent vertically after assembled to the covers 50. Each pair of wings 611 respectively extends from opposite upper and lower edges of the cover retention section 61, and the two pairs of wings 611 are arranged in the front-to-back direction. Each wing 611 defines a retaining hole 6111 thereon. The pushing section 64 defines a plurality of protrusions 641 on an outer surface thereof for handling concentrically. A pair of stopping sections 67 extends towards the cover retention section 61 from opposite sides of the pushing section 64. The positioning section 65 comprises a pair of vertically extending positioning tabs 651 and a pair of vertically extending recesses 652 for assuring fixed assembly. The latch section 66 comprises a protrusion 661 and a locking tab 662 bent and extending outwardly from a lower edge thereof.

Referring to FIGS. 7 to 11, in assembly, the housing retention section 62 is received in the first retention cavity 111 of the housing 10 with the retention tabs 621 being engaged therein. The cover retention section 61 received in the second retention cavity 55 of the cover 50. The pushing section 64 and the stopping section 67 are located in the depression (not labeled) formed by the side portion 511 of the cover 50, and the stopping section 67 extends towards the cover 50. The latch section 66 is received in the first retention cavity 111 of the housing 10 and the locking tab 662 projects outside the housing 10 for latching with the complementary connector. The wings 611 are respectively passing through corresponding passages 514 to be exposed outside the cover 50, and then the distal end of the wings 611 are bent to make the wings 611 locate in the depression portions in the depression portions 518 of the covers 50 with the retaining holes 6111 locking with corresponding projections 519. The wings 611 exert forces to the upper and the lower covers 51, 52 along said up-to-down direction to hold the upper and the lower covers 51, 52 together. When the cable connector assembly 1 mates with the complementary connector, an inward pressing force is firstly exerted on the pushing sections 64 of the locking members 60 by user's fingers to drive the latch section 66 to move inwardly. Once the pressing force is released, the latch section 66 restore to their original position due to their own elasticity and thus locks with the complementary connector via the locking tab 662. When the cable end connector assembly 1 is to be disengaged from the complementary connector, a contrary operating procedure is applied.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

I claim:

1. A cable connector assembly for mating with a complementary connector, comprising:

an insulative housing defining a forwardly extending mating port with a pair of opposite side portions by two sides thereof, each of said side portions defining a first retention cavity extending in a front-to-back direction;

a plurality of contacts disposed in the housing;

a plurality of rearwardly extending cables including a plurality of conductors connected to the contacts;

a pair of upper and lower covers assembled to a rear portion of the housing and assembled with each other in an up-to-down direction perpendicular to said front-to-back direction, and enclosing front portions of the cables together, and defining a pair of opposite side portions with a pair of U-shaped second retention cavities therein, respectively, the first retention cavities aligned with the corresponding second retention cavities in a front-to-back direction; and a pair of locking members assembled to the housing and the upper and lower covers, each locking member comprising a housing retention section engagingly received in the first receiving cavity of the housing, a cover retention section engagingly received in the second receiving cavities of the upper and the lower covers, a spring section movable received in the second retention cavities and at least a pair of wings being formed with the cover retaining section;

wherein the wings respectively corporate with the upper and the lower covers and exert forces to the upper and the lower covers along said up-to-down direction to hold the upper and the lower covers together.

2. The cable connector assembly as described in claim 1, wherein the upper and the lower covers, respectively, comprises a pair of passages extending through the upper cover and the lower cover in the up-to-down direction, and being disposed at in the front-to-back direction, said wings pass through corresponding passage along the up-to-down direction, respectively, and are bent to engage with the outer face of the upper and the lower cover.

3. The cable connector assembly as be described in claim 2, wherein the upper cover and the lower cover; each defines a pair of depression portions on the outer face corresponding to the passages, and each depression portion defines a projection therein, each wing further comprises a retaining hole at the distal end thereof, the retaining hole engaging with corresponding projection.

4. The cable connector assembly as described in claim 3, wherein the upper cover and the lower cover each comprises a body portion, said side portions form at the opposite sides of the body portion, and comprises a U-shaped receiving cavity, the receiving cavities on the upper cover and lower cover are formed said second retention cavities.

5. The cable connector assembly as described in claim 4, wherein said body portion and said side portion are divided by a beam therebetween, said passages are disposed at the second receiving cavity in a front-to-back direction and adjacent to the beam.

6. The cable connector assembly as described in claim 1, wherein each locking member comprises at one end thereof, a housing retention section retaining in the housing, a cover retention section extending from the housing retention section and retaining in the cover, said spring section extending from the cover retention section, a pushing section extending outside from the spring section and said latch section at another end thereof for locking with a complementary connector.

7. The cable connector assembly as described in claim 1, wherein the cables comprise at least a first cable and at least a second cable transmitting different types of signal.

8. The cable connector assembly as described in claim 7, wherein the first cable is the standard cable of the Serial Advanced Technology Attachment (SATA) II and used to transport the high-speed signals.

9. The cable connector assembly as described in claim 7, wherein the second cable is used to transport the low-speed signals.

10. The cable connector assembly as described in claim 1, further comprises a spacer mounted on a rear end of the housing to seal rear end of the housing to prevent plastic material from entering into the passageways of the housing.

11. The cable connector assembly as described in claim 1, wherein the housing defines a receiving space therein and a partition wall extending along a longitudinal direction, the receiving space is divided by a partition wall into two ports.

12. The cable connector assembly as described in claim 11, wherein one of the two ports of the housing is L-shaped.

13. The cable connector assembly as described in claim 1, further comprises an insulator over-molded received in the covers.

14. A cable assembly comprising:

an insulative housing with a plurality of terminals therein;

a cover device including in a vertical direction top and bottom covers sandwiching said housing therebetween; and a pair of latches located on two sides of the cover device, each of said latches including a securing section fixed to the cover device and a resilient section with a hook thereof for latching to a complementary connector; wherein the securing section defines upper and lower tabs which are originally in an extended manner to extend through corresponding slits of the top and bottom covers, and successively bent angularly to abut against the top and bottom covers, respectively, for holding said top and bottom covers together in said vertical direction.

15. A method of making a cable connector assembly comprising steps of:

providing an insulative housing;

providing a cover device with top and bottom covers in a vertical direction to sandwich said housing therebetween; and disposing a pair of latches on two sides of the cover device, each of said latches defining a securing section for holding to the cover device, and a resilient section with a hook for coupling to a complementary connector, wherein said securing section includes upper and lower tabs which are initially in an extended manner to extend through corresponding slots of the top and bottom covers, respectively, and successively bent in an angular manner to abut against the top and bottom covers for securing said top and bottom covers together in said vertical direction.

* * * * *